US009193934B2

(12) United States Patent
Delbridge et al.

(10) Patent No.: US 9,193,934 B2
(45) **Date of Patent: *Nov. 24, 2015**

(54) STABILIZED BLENDS CONTAINING FRICTION MODIFIERS

(75) Inventors: Ewan E. Delbridge, Concord Township, OH (US); John J. Mullay, Mentor, OH (US); James D. Burrington, Gates Mills, OH (US); Jonathan R. Sharpe, Indianapolis, IN (US); John W. Dunkerley, Belper (GB)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/512,693

(22) PCT Filed: Nov. 17, 2010

(86) PCT No.: PCT/US2010/056923

§ 371 (c)(1),
(2), (4) Date: Sep. 10, 2012

(87) PCT Pub. No.: WO2011/066145

PCT Pub. Date: Jun. 3, 2011

(65) Prior Publication Data

US 2013/0005627 A1 Jan. 3, 2013

Related U.S. Application Data

(60) Provisional application No. 61/264,871, filed on Nov. 30, 2009.

(51) Int. Cl.

| | |
|---|---|
| ***C10M 173/02*** | (2006.01) |
| ***C10M 169/04*** | (2006.01) |
| ***C07D 233/14*** | (2006.01) |
| ***C10M 171/06*** | (2006.01) |

(52) U.S. Cl.

CPC ..... *C10M 169/04* (2013.01); *C10M 171/06* (2013.01); *C10M 2207/289* (2013.01); *C10M 2215/062* (2013.01); *C10M 2215/064* (2013.01); *C10M 2215/08* (2013.01); *C10M 2215/223* (2013.01); *C10M 2215/224* (2013.01); *C10M 2215/225* (2013.01); *C10M 2215/28* (2013.01); *C10M 2219/046* (2013.01); *C10M 2219/089* (2013.01); *C10M 2223/04* (2013.01); *C10M 2223/042* (2013.01); *C10M 2223/045* (2013.01); *C10M 2223/047* (2013.01); *C10M 2223/049* (2013.01); *C10N 2230/70* (2013.01)

(58) Field of Classification Search

USPC ..... 508/189, 519, 283, 287

See application file for complete search history.

(56) References Cited

U.S. PATENT DOCUMENTS

| | | | | |
|---|---|---|---|---|
| 4,428,850 | A | 1/1984 | Zoleski et al. | |
| 5,674,821 | A | 10/1997 | Cook et al. | |
| 6,348,438 | B1 | 2/2002 | Le Coent et al. | |
| 6,759,375 | B2 | 7/2004 | Curtis et al. | |
| 7,935,664 | B2 | 5/2011 | Dowding et al. | |
| 2004/0235678 | A1 | 11/2004 | Di Biase et al. | |
| 2006/0030498 | A1 | 2/2006 | Hartley | |
| 2006/0079413 | A1 | 4/2006 | Kocsis et al. | |
| 2006/0105925 | A1 | 5/2006 | Fellows et al. | |
| 2006/0276352 | A1* | 12/2006 | Vinci | 508/272 |
| 2009/0093385 | A1 | 4/2009 | Dowding et al. | |
| 2009/0093386 | A1 | 4/2009 | Dowding et al. | |
| 2009/0270284 | A1* | 10/2009 | Kikuchi et al. | 508/108 |
| 2010/0081594 | A1 | 4/2010 | Walker | |
| 2010/0210487 | A1 | 8/2010 | Deblase et al. | |

FOREIGN PATENT DOCUMENTS

| | | |
|---|---|---|
| EP | 0780460 | 6/1997 |
| EP | 1657292 | 5/2006 |
| WO | 2008067259 | 6/2008 |
| WO | 2008076825 | 6/2008 |
| WO | 2008147704 | 12/2008 |
| WO | 2010141530 | 12/2010 |

OTHER PUBLICATIONS

Corresponding PCT Publication No. WO 2011/066145 A1 and Search Report published Jun. 3, 2011.

Written Opinion from corresponding International Application No. PCT/US2010/056923 dated Feb. 7, 2011.

* cited by examiner

*Primary Examiner* — Vishal Vasisth

(74) *Attorney, Agent, or Firm* — Iken S. Sans; Christopher D. Hilker; Teresan W. Gilbert

(57) ABSTRACT

The present invention relates to functional fluid compositions containing friction modifiers, and specifically stable compositions containing friction modifiers with limited solubility in and/or limited compatibility with the functional fluids with which they are used. In particular the present invention deals with functional fluids used in internal combustion engines, such as engine oils, and friction modifiers derived from hydroxy-carboxylic acids, where the friction modifier is present in the functional fluid composition at levels that would otherwise cause the composition to be unstable and/or hazy.

10 Claims, No Drawings

STABILIZED BLENDS CONTAINING FRICTION MODIFIERS

This application is a 371 of PCT/US10/56923, filed Nov. 17, 2010, which claims benefit of 61/264,871, filed Nov. 30, 2009.

BACKGROUND OF THE INVENTION

The present invention relates to functional fluid compositions containing friction modifiers, and specifically stable compositions containing friction modifiers with limited solubility in and/or limited compatibility with the functional fluids with which they are used.

Friction modifiers and their importance to various types of functional fluids are known. However, many friction modifiers may only be used in limited ways due to solubility and/or compatibility issues with the functional fluids in which they are used. Many friction modifiers, and specifically those derived from hydroxy-carboxylic acids, have limited solubility in functional fluids, such as engine oils and gear oils. These friction modifiers, when used at levels above their solubility and/or compatibility limits, may fall out of the functional fluid composition over time and/or cause the composition to appear hazy or cloudy.

These are serious issues in the manufacturing and blending processes of the fluids as well as in the field. For example, a functional fluid additive manufacturer would sell a homogeneous additive package of performance chemicals, which may then be added to a base oil to give a final lubricant, which in turn is sold in tanks, drums, cans and plastic containers for final delivery of the lubricant to the equipment to be lubricated. To maintain assurance of performance of the final lubricant, or any other functional fluid, in the equipment in which it is used, the concentrate and the lubricant must remain homogeneous throughout these steps. In other words, all of the additives present must be compatible with each of the various materials it comes into contact with and/or finds itself, from the additive package to the concentrate to the final fluid. This stringent standard greatly limits the choices of and available treatment levels for many additives, including the friction modifiers discussed herein. These friction modifiers could provide improved performance to a functional fluid but not widely used and/or are not used at the optimal level because the additive does not meet the solubility and/or compatibility requirements discussed above.

In the field, functional fluid compositions that drop out one or more components over time may not perform properly unless they are well-mixed before use, or may be removed by filters associated with the equipment in which the functional fluid is used. The haziness and/or cloudiness of a functional fluid, which may be measured as the fluid's turbidity, is often seen as a sign the composition is not stable, or may be in an early stage of separation and/or component drop out. Such conditions are not desired in functional fluid compositions, for both performance and aesthetic related reasons. This reality has created constraints on the use of various friction modifiers, such as effective maximum treat rates.

Without these solubility and/or compatibility limitations on the use of these friction modifiers, greater performance and equipment protection might be achievable, including for example extended life of a lubricant or a lubricated piece of equipment such as engines, automatic transmissions, gear assemblies and the like. Improved fuel economy and viscosity stability might be achievable as well. Greater performance may even be achievable with lesser amounts of chemical as well as greater amounts, depending on the selection of the more effective, but otherwise not suitable chemicals from a compatibility or solubility standpoint when delivered in a conventional manner.

There is a need for functional fluid compositions that contain higher amounts of friction modifiers while still remaining stable and/or clear. There is particularly a need for functional fluid compositions, such as engine oil compositions, that contain friction modifiers derived from a hydroxy-carboxylic acid, at levels that would otherwise cause the composition to be unstable and/or hazy, as described above. The compositions and methods of the present invention overcome these constraints and thus allow the use of these friction modifiers at levels not otherwise possible while still maintaining the stability and/or clarity of the functional fluid composition.

SUMMARY OF THE INVENTION

Functional fluid compositions have been discovered that may contain high amounts of friction modifiers, and particularly friction modifiers with limited solubility in and/or compatibility with the functional fluid compositions in which they are used, allowing for the use of higher amounts of such friction modifiers in these functional fluid compositions, while maintaining the stability, clarity, and/or compatibility of the overall composition.

The present invention provides a composition that includes: (a) a medium, which may include a solvent, a functional fluid, or combinations thereof; and (b) a friction modifier component that is not fully soluble in the medium; and (c) a stabilizing component that is soluble in (a) and that interacts with (b) such that (b)'s solubility in (a) is improved, or perhaps more accurately, (b)'s solubility in the combination of (a) and (b) is improved over (b)'s solubility in (a). Components (b) and (c) may be present in component (a) in the form of dispersed particles having an average diameter of less than 10 microns.

In some embodiments component (b), the friction modifier, includes a compound derived from a hydroxy-carboxylic acid and component (c), the stabilizing component, includes: (i) a phosphorus-containing additive; and may further optionally include (ii) a nitrogen-containing dispersant or borated version thereof; (iii) an overbased detergent with a metal to substrate ratio of greater than 3:1; or combinations thereof. In some embodiments the phosphorus containing additive of component (c) includes a phosphate, a phosphite, a thiophosphate, a salt of any of these materials, or any combination thereof. Suitable examples include: (i) a hydrocarbyl phosphoric acid or acid ester; (ii) an amine salt thereof; or combinations thereof.

In some embodiments the compositions of the present invention result in an improvement in the turbidity of the composition, as defined by a lower Jackson Turbidity Unit (JTU) and/or Nephelometric Turbidity Unit (NTU) value compared to the same composition that does not contain (c), the stabilizing component. In some embodiments the compositions of the present invention have a maximum JTU and/or NTU value of 100.

The present invention also provides for a process of preparing a clear and stable composition, as described herein, said method including the steps of: (I) adding components (b) and (c) to component (a); and (II) mixing the components so that particles of components (b) and (c), or in some embodiments particles of (b) alone, have an average diameter of less than 10 microns, or in other embodiments and more specifically, no more than 10 percent by weight of the particles have a diameter of more than 0.5 microns. In addition, component (b) may be present in the overall composition at a minimum amount, such as no less than 0.15 percent by weight.

DETAILED DESCRIPTION OF THE INVENTION

Various preferred features and embodiments will be described below by way of non-limiting illustration.

The present invention provides compositions and methods that allow for the use of certain friction modifiers in functional fluid compositions that could not otherwise be used, and/or could not be used at the levels allowed for by the present invention, without resulting in unstable, unclear, and/or hazy compositions.

The types of functional fluids in and with which the compositions and methods of the present invention may be used can include: gear oils, transmission oils, hydraulic fluids, engine oils, two cycle oils, metalworking fluids, fuels and the like. In one embodiment the functional fluid is engine oil. In another embodiment the functional fluid is gear oil. In another embodiment the functional fluid is a transmission fluid. In another embodiment the functional fluid is a hydraulic fluid. In another embodiment the functional fluid is a fuel.

In some embodiments the present invention does not include the use of a delivery device, for example a device that acts to contain the friction modifier and contact it with the functional fluid with which it is to be added. In some embodiments the present invention does not included the use of either a gel composition or a solid composition, where such compositions slow release one or more components into a functional fluid. Rather the present invention provides a means for incorporating friction modifiers into functional fluids, by use of a combination of components, which result in a functional fluid with the high level of friction modifier while still being stable, clear and/or non-hazy.

In some embodiments the present invention provides a composition that is more stable, clearer, and/or less hazy than a composition that is identical except for it missing one or more components. In some embodiments the missing component is the stabilizing component. In other embodiments the compositions of the present invention have a lower turbidity compared to compositions that are identical except for them missing the stabilizing component of the present invention. In some of these embodiments, the compositions' turbidity is expressed as a JTU and/or NTU value. In other embodiments the compositions of the present invention have a maximum JTU and/or NTU value of 100, of 90 or even of 80.

JTU and NTU values may be measured US EPA method 180.1. JTU and NTU values may also be measured without any further dilution in Jackson Turbidity Units (JTU's) by using a Monitek Model 151 Turbidimeter.

The Medium

The compositions of the present invention include a medium. The medium may be a solvent, a functional fluid, an additive concentrate, or combinations thereof.

Suitable solvents include aliphatic hydrocarbons, aromatic hydrocarbons, oxygen containing compositions, or mixtures thereof. The oxygen containing composition can include an alcohol, a ketone, an ester of a carboxylic acid, a glycol and/or a polyglycol, or a mixture thereof. Suitable solvents also include oils of lubricating viscosity, naphtha, toluene, xylene, or combinations thereof. The oil of lubricating viscosity can comprise natural oils, synthetic oils, or mixtures thereof. The oil of lubricating viscosity can be an API (American Petroleum Institute) Group II, III, IV, V base oil or mixture thereof. Examples of commercially available aliphatic hydrocarbon solvents or diluents, to include oils of lubricating viscosity, are Pilot™ 140 and Pilot™ 299 and Pilot™ 900 available from Petrochem Carless, Petro-Canada™ 100N, Nexbase™, Yubase™, and 4 to 6 cSt poly(alpha-olefins).

Suitable functional fluids include any of the functional fluids listed above, including mixtures of such fluids. In many embodiments the functional fluids, or other materials used as the medium, contain additional additives in addition to components (b) and (c) described in detail below. These additional additives are described in greater detail below.

In one embodiment of the invention the medium and/or the overall composition is substantially free of or free of at least one member selected from the group consisting of sulphur, phosphorus, sulfated ash, and combinations thereof, and in other embodiments the fuel composition contains less than 20 ppm, less than 15 ppm, less than 10 ppm, or less than 1 ppm of at least one member selected from the group consisting of sulphur, phosphorus, sulfated ash, and combinations thereof.

In one embodiment, the medium and the stabilizing component may be the same material. That is one material may perform the functions of both components. For example when the invention is in the form of a concentrate the medium present may act as a stabilizing component and vice versa. This concentrate may then be added to a functional fluid as a top treat and/or additive package, resulting in a stable and homogeneous functional fluid which would otherwise be cloudy or incompatible in the absence of stabilizer component/medium material.

The Friction Modifier

The compositions of the present invention include a friction modifier component. The friction modifier component may include a least one friction modifier that is not fully soluble and/or compatible in the medium and/or functional fluid in which it is to be used. By not fully soluble and/or compatible, it is meant that the friction modifier does not stay dissolved and/or suspended in the fluid to which it is added, causes the fluid to appear hazy and/or cloudy, or any combination thereof. In some embodiments, the friction modifier causes the fluid in which it is used to have an NTU and/or JTU value above 80, 90 or even 100. In some embodiments this fluid is a functional fluid composition such as a finished lubricant or an additive concentrate.

In some embodiments the friction modifier of the present invention is soluble and/or compatible with a fluid at low concentrations, but becomes less than soluble and/or compatible at higher concentrations. In some embodiments friction modifiers suitable for use in the present invention are not fully soluble and/or compatible, as defined above, when present in a fluid at concentrations of or more than 0.1, 0.15, 0.2, 0.3, 0.5, or 1.0 percent by weight.

In some embodiments the friction modifier of the present invention includes a compound derived from a hydroxy-carboxylic acid. Suitable acids may include from 1 to 5 or 2 carboxy groups, and from 1 to 5 or 2 hydroxy groups. In some embodiments the friction modifier is derived from a hydroxy-carboxylic acid represented by Formula I.

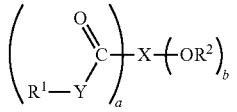

(I)

wherein:

a and b may be independently integers of 1 to 5, or 1 to 2; X may be an aliphatic or alicyclic group, or an aliphatic or alicyclic group containing an oxygen atom in the carbon chain, or a substituted group of the foregoing types, said group containing up to 6 carbon atoms and having a+b available points of attachment; each Y may be independently —O—, >NH, or >$NR^3$ or two Y's together representing the nitrogen of an imide structure $R^1$—N< formed between two carbonyl groups; and each $R^1$ and $R^3$ may be independently hydrogen or a hydrocarbyl group, provided that at least one $R^1$ and $R^3$ group may be a hydrocarbyl group; each $R^2$ may be independently hydrogen, a hydrocarbyl group or an acyl group, further provided that at least one —$OR^2$ group is located on a carbon atom within X that is α or β to at least one of the —C(O)—Y—$R^1$ groups and further provided that at least one $R^2$ is hydrogen.

The hydroxy-carboxylic acid is reacted with an alcohol and/or an amine, via a condensation reaction, forming the friction modifier additive.

In one embodiment the hydroxy-carboxylic acid is represented by Formula II.

(II)

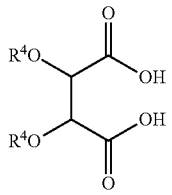

wherein each $R^4$ is independently H or a hydrocarbyl group, or wherein the $R^4$ groups together form a ring. In one embodiment, where $R^4$ is H, the condensation product is optionally further functionalized by acylation or reaction with a boron compound. In another embodiment the friction modifier is not borated.

In any of the embodiments above, the hydroxy-carboxylic acid may be tartaric acid, citric acid, or combinations thereof, and may also be a reactive equivalent of such acids (including esters, acid halides, or anhydrides). The resulting friction modifiers may include imide, di-ester, di-amide, or ester-amide derivatives of tartaric acid, citric acid, or mixtures thereof. In one embodiment the derivative of hydroxycarboxylic acid includes an imide, a di-ester, a di-amide, an imide amide, an imide ester or an ester-amide derivative of tartaric acid or citric acid.

The amines used in the preparation of the friction modifier may have the formula RR'NH wherein R and R' each independently represent H, a hydrocarbon-based radical of 1 or 8 to 30 or 150 carbon atoms, that is, 1 to 150 or 8 to 30 or 1 to 30 or 8 to 150 atoms. Amines having a range of carbon atoms with a lower limit of 2, 3, 4, 6, 10, or 12 carbon atoms and an upper limit of 120, 80, 48, 24, 20, 18, or 16 carbon atoms may also be used. In one embodiment, each of the groups R and R' has 8 or 6 to 30 or 12 carbon atoms. In one embodiment, the sum of carbon atoms in R and R' is at least 8. R and R' may be linear or branched.

The alcohols useful for preparing the friction modifier will similarly contain 1 or 8 to 30 or 150 carbon atoms. Alcohols having a range of carbon atoms from a lower limit of 2, 3, 4, 6, 10, or 12 carbon atoms and an upper limit of 120, 80, 48, 24, 20, 18, or 16 carbon atoms may also be used. In certain embodiments the number of carbon atoms in the alcohol-derived group may be 8 to 24, 10 to 18, 12 to 16, or 13 carbon atoms.

The alcohols and amines may be linear or branched, and, if branched, the branching may occur at any point in the chain and the branching may be of any length. In some embodiments the alcohols and/or amines used include branched compounds, and in still other embodiments, the alcohols and amines used are at least 50%, 75% or even 80% branched. In some embodiments the alcohols are linear.

In some embodiments, the alcohol and/or amine have at least 6 carbon atoms. Accordingly, certain embodiments of the invention employ the product prepared from branched alcohols and/or amines of at least 6 carbon atoms, for instance, branched $C_{6-18}$ or $C_{8-18}$ alcohols or branched $C_{12-16}$ alcohols, either as single materials or as mixtures. Specific examples include 2-ethylhexanol and isotridecyl alcohol, the latter of which may represent a commercial grade mixture of various isomers. Also, certain embodiments of the invention employ the product prepared from linear alcohols of at least 6 carbon atoms, for instance, linear $C_{6-18}$ or $C_{8-18}$ alcohols or linear $C_{12-16}$ alcohols, either as single materials or as mixtures.

The tartaric acid used for preparing the tartrates, tartrimides, or tartramides of the invention can be the commercially available types (obtained from Sargent Welch), and it exists in one or more isomeric forms such as d-tartaric acid, l-tartaric acid, d,l-tartaric acid or meso-tartaric acid, often depending on the source (natural) or method of synthesis (e.g. from maleic acid). These derivatives can also be prepared from functional equivalents to the diacid readily apparent to those skilled in the art, such as esters, acid chlorides, anhydrides, etc.

In one embodiment the friction modifier can be represented by a compound of Formula (III)

(III)

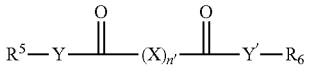

wherein:

n' is 0 to 10; p is 1 to 5; Y and Y' are independently —O—, >NH, >$NR^7$, or an imide group formed by the linking of the Y and Y' groups forming a $R^1$—N< group between two >C═O groups; $R^5$ and $R^6$ are independently hydrocarbyl groups, typically containing 1, 4 or 6 to 150, 30 or 24 carbon atoms; and X is independently —$CH_2$—, >$CHR^8$ or >$CR^8R^9$, >$CHOR^{10}$, >$C(OR^{10})CO_2R^{10}$, or >$C(CO_2R^{10})_2$, —$CH_3$, —$CH_2R^8$ or —$CHR^8R^9$, —$CH_2OR^{10}$, or —$CH(CO_2R^{10})_2$, or mixtures thereof wherein: $R^7$ is a hydrocarbyl group; $R^8$ and $R^9$ are independently keto-containing groups (such as acyl groups), ester groups or hydrocarbyl groups; and $R^{10}$ is independently hydrogen or a hydrocarbyl group, typically containing 1 to 150 carbon atoms.

In some embodiments the compounds represent by Formula (III) have at least one X that is hydroxyl-containing (e.g., >$CHOR^{10}$, wherein $R^{10}$ hydrogen). When X is hydroxyl-containing, the compound may be derived from hydroxy-carboxylic acids such as tartaric acid, citric acid, or mixtures thereof. In one embodiment the compound is derived from citric acid and $R^5$ and $R^6$ contain at least 6 or 8 carbon atoms up to 150, or 6 or 8 to 30 or 24 carbon atoms. In one embodiment the compound is derived from tartaric acid and $R^5$ and $R^6$ contain 4 or 6 to 30 or 24 carbon atoms. When X is not hydroxyl-containing, the compound may be derived from malonic acid, oxalic acid, chlorophenyl malonic acid, or mixtures thereof.

In one embodiment the friction modifier component of the present invention includes oleyl tartrimide, stearyl tartrimide, 2-ethylhexyl tartrimide, or combinations thereof. The friction modifier may be present in the compositions of the present invention at levels of at least 0.1, 0.15, 0.2, 0.3, 0.5 or even 1.0 percent by weight. The friction modifier may be present at less than 10, 7.5, 5, or even 4 or 3 percent by weight.

The compositions of the present invention, and specifically the friction modifier component, may optionally include one or more additional friction modifiers. These additional friction modifiers may or may not have the solubility and/or compatibility issues of the friction modifiers described above. Also, these additional friction modifiers may or may not help to stabilize the overall composition. These additional friction modifiers may include esters of polyols such as glycerol monooleates, as well as their borated derivatives; fatty phosphites; fatty acid amides such as oleyl amides; borated fatty epoxides; fatty amines, including borated alkoxylated fatty amines; sulfurized olefins; and mixtures thereof.

Esters of polyols include fatty acid esters of glycerol. These can be prepared by a variety of methods well known in the art. Many of these esters, such as glycerol monooleate and glycerol mono-tallowate, are manufactured on a commercial scale. The esters useful for this invention are oil-soluble and are preferably prepared from $C_8$ to $C_{22}$ fatty acids or mixtures thereof such as are found in natural products. The fatty acid may be saturated or unsaturated. Certain compounds found in acids from natural sources may include licanic acid which contains one keto group. Useful $C_8$ to $C_{22}$ fatty acids are those of the formula R—COOH wherein R is alkyl or alkenyl.

The fatty acid monoester of glycerol is useful. Mixtures of mono and diesters may be used. Mixtures of mono- and diester can contain at least about 40% of the monoester. Mixtures of mono- and diesters of glycerol containing from about 40% to about 60% by weight of the monoester can be used. For example, commercial glycerol monooleate containing a mixture of from 45% to 55% by weight monoester and from 55% to 45% diester can be used.

Useful fatty acids are oleic, stearic, isostearic, palmitic, myristic, palmitoleic, linoleic, lauric, linolenic, and eleostearic, and the acids from the natural products such as tallow, palm oil, olive oil, peanut oil.

Although tartrates and esters of polyols such as glycerol monooleate may appear to have superficially similar molecular structures, it is observed that certain combinations of these materials may actually provide better performance, e.g., in wear prevention, than either material used alone.

Fatty acid amides have been discussed in detail in U.S. Pat. No. 4,280,916. Suitable amides are $C_8$-$C_{24}$ aliphatic monocarboxylic amides and are well known. Reacting the fatty acid base compound with ammonia produces the fatty amide. The fatty acids and amides derived there from may be either saturated or unsaturated. Important fatty acids include lauric acid ($C_{12}$), palmitic acid ($C_{16}$), and stearic acid ($C_{18}$). Other important unsaturated fatty acids include oleic, linoleic and linolenic acids, all of which are $C_{18}$. In one embodiment, the fatty amides of the instant invention are those derived from the $C_{18}$ unsaturated fatty acids.

The fatty amines and the diethoxylated long chain amines such as N,N-bis-(2-hydroxyethyl)-tallowamine themselves are generally useful as components of this invention. Both types of amines are commercially available. Fatty amines and ethoxylated fatty amines are described in greater detail in U.S. Pat. No. 4,741,848.

In some embodiments the compositions of the present invention do not include any of these optional friction modifiers and in other embodiments, one or more of any of the optional friction modifiers listed herein are not present in the compositions of the present invention.

In other embodiments an additional friction modifier is present, and that friction modifier is an amide of an aliphatic carboxylic acid containing 6 to 28 carbon atoms. In other embodiments the additional friction modifier is an amide of stearic acid, oleic acid, or combinations thereof.

The Stabilizing Component

The compositions of the present invention include a stabilizing component. The stabilizing component of the present invention is soluble in medium and that interacts with the friction modifier such that its solubility in the medium and/or overall composition is improved. This may be accomplished by an association of the stabilizing component and the friction modifier, resulting in suspended particles of the associated molecules, that remain suspended, dispersed and/or dissolved in the medium and/or overall composition to an extent greater than obtained by the friction modifier alone.

The stabilizing component of the present invention is an additive that, when combined with the friction modifier in the medium, results in an improvement in the turbidity of the composition, compared to the same composition that does not contain the stabilizing component.

In some embodiments component (b), the friction modifier, includes a compound derived from a hydroxy-carboxylic acid and component (c), the stabilizing component, includes: (i) a phosphorus-containing additive; and may further optionally include (ii) a nitrogen-containing dispersant or borated version thereof; (iii) an overbased detergent with a metal to substrate ratio of greater than 3:1; or combinations thereof. In some embodiments the phosphorus containing additive of component (c) includes a phosphate, a phosphite, a thiophosphate, a salt of any of these materials, or any combination thereof. Suitable examples include: (i) a hydrocarbyl phosphoric acid or acid ester; (ii) an amine salt thereof; or combinations thereof.

The Phosphorus Containing Additive.

The stabilizing component may include a phosphorus containing additive, such as an amine salt of a hydrocarbyl phosphate, a hydrocarbyl thiophosphate, a hydrocarbyl dithiophosphate, or combinations thereof. Such additives are generally prepared by reacting one or more phosphorus acids, such as a phosphoric, thiophosphoric, including dithiophosphoric, acids, with an unsaturated amide, such as an acrylamide, and also include amine salts of full or partial esters of phosphoric or thiophosphoric acids.

Phosphorus-containing acids suitable for use in preparing the stabilizing component of the present invention include phosphorus acid esters prepared by reacting one or more phosphorus acids or anhydrides with an alcohol. The alcohol used may contain up to about 30, 24, 12 or even 3 carbon atoms. The phosphorus acid or anhydride may be an inorganic phosphorus reagent, such as phosphorus pentoxide, phosphorus trioxide, phosphorus tetraoxide, phosphorus acid, phosphorus halide, lower phosphorus esters, or a phosphorus sulfide, including phosphorus pentasulfide. In some embodiments the phosphorus acid or anhydride is phosphorus pentoxide, phosphorus pentasulfide, phosphorus trichloride, or combinations thereof. The phosphorus acid ester may be a mono- or diester of phosphoric acid or mixtures thereof.

Examples of commercially available alcohols include Alfol 810 (a mixture of primarily straight chain, primary alcohols having from 8 to 10 carbon atoms); Alfol 1218 (a mixture of synthetic, primary, straight-chain alcohols containing 12 to 18 carbon atoms); Alfol 20+ alcohols (mixtures of $C_{18}$-$C_{28}$ primary alcohols having mostly $C_{20}$); and Alfol 22+ alcohols ($C_{18}$-$C_{28}$ primary alcohols containing primarily $C_{22}$ alcohols).

In another embodiment, the phosphorus-containing acid is a thiophosphorus acid ester and may be a mono- or dithiophosphorus acid ester. Thiophosphorus acid esters are also referred to as thiophosphoric acids. The thiophosphorus acid ester may be prepared by reacting a phosphorus sulfide, such as those described above, with any of the alcohols described above. Monothiophosphoric acid esters, or monothiophosphates, may be prepared by the reaction of a sulfur source, such as elemental sulfur, with a dihydrocarbyl phosphite. The sulfur source may also be an organosufide, such as a sulfur coupled olefin or dithiophosphate. Monothiophosphates may also be formed in the lubricant blend by adding a dihydrocarbyl phosphite to a lubricating composition containing a sulfur source, such as a sulfurized olefin.

Dithiophosphoric acids, or phosphorodithioic acids, may be reacted with an epoxide or a glycol and further reacted with a phosphorus acid, anhydride, or lower ester. The epoxide may be an aliphatic epoxide or a styrene oxide, such as ethylene oxide, propylene oxide, butene oxide, octene oxide, dodecene oxide, and styrene oxide. In one embodiment propylene oxide is used. The glycols may be aliphatic glycols having from for 2 to 12, 6 or 3 carbon atoms. These materials may be reacted with $P_2O_5$. The resulting materials, as well as the other described herein may then be reacted with an amine to form a salt.

As noted above, the acidic phosphoric acid esters described above may be reacted with ammonia or an amine compound to form an ammonium salt. The salts may be formed separately and then the salt of the phosphorus acid ester may be added to the lubricating composition. Alternately, the salts may also be formed in situ when the acidic phosphorus acid ester is blended with other components to form a fully formulated lubricating composition.

Suitable amines include monoamines and polyamines, including those described above. The amines may be primary amines, secondary amines or tertiary amines. Useful monoamines may contain from 1 to 24, 14 or 8 carbon atoms, including methylamine, ethylamine, propylamine, butylamine, octylamine, and dodecylamine, dimethylamine, diethylamine, dipropylamine, dibutylamine, methyl butylamine, ethyl hexylamine, trimethylamine, tributylamine, methyl diethylamine, ethyl dibutylamine and the like.

In one embodiment, the amine may be a fatty ($C_{4-30}$) amine that include but are not limited to n-hexylamine, n-octylamine, n-decylamine, n-dodecylamine, n-tetradecylamine, n-hexadecylamine, n-octadecylamine, oleylamine and the like. Some examples are commercially available fatty amines such as "Armeen" amines (products available from Armak Chemicals, Chicago, Ill.), such as Armak's Armeen-C, Armeen-O, Armeen-OL, Armeen-T, Armeen-HT, Armeen S and Armeen SD, wherein the letter designation relates to the fatty group, such as cocoa, oleyl, tallow, or soya groups.

A useful amine is a C12-14 branched tertiary alkyl primary amine supplied by Rohm and Haas under the trade name Primene 81R. In one embodiment, the stabilizing component is an amine salt of a mixture of phosphoric acids and esters and/or an amine salt of a mixture of dithiophosphoric acids and esters, where the mixtures are salted with Primene 81R or a similar amine or mixture of amines.

The preparation of these phosphorus containing additives, including the amine salts of the acids and esters described above, is discussed in greater detail in U.S. Pat. No. 6,617,287.

In some embodiments the phosphorus containing additive of component (c) includes a phosphate, a phosphite, a thiophosphate, an amine salt of any of these materials, or any combination thereof. In some embodiments component (c) includes: (i) a hydrocarbyl phosphoric acid or acid ester; (ii) an amine salt thereof; or combinations thereof. In still other embodiments component (c) includes a compound represent by the following formula:

$$(X^1{=})_aP(X^2{}_b{-}R)_3$$

or a salted version thereof wherein: each $X^1$ is independently O or S, a is 0 or 1, each $X^2$ is independently O or S, b is 0 or 1, and R is H or a hydrocarbyl group. In some embodiments the phosphorus containing additive is salted with an amine.

The Nitrogen-Containing Dispersant or Borated Version Thereof.

In some embodiments the stabilizing component may optionally further include a nitrogen-containing dispersant or borated version thereof. The nitrogen-containing dispersant may be a reaction product of a hydrocarbyl-substituted succinic acylating agent and a polyamine, which may optionally be borated. Such materials are described in U.S. Pat. No. 4,234,435.

The hydrocarbyl-substituted succinic acylating agents can include succinic acids, halides, esters, and anhydrides. In some embodiments the agents are succinic anhydrides. In one embodiment, the hydrocarbyl groups of the agents are derived from polyalkenes having an Mn (number average molecular weight) of from 500, 750, or 850 up to 5000, 3000, 2000, or 1600, and the polydispersity, (Mw/Mn), that is, the ratio of the weight average molecular weight over the number average molecular weight is from 1.5, 1.8, or 2, or to 2.5, 3.6, or 3.2. In some embodiments, the nitrogen free dispersant of the present invention is derived from a hydrocarbon polymer, such as polyisobuylene (PIB), that substantially free of polymer having a Mn of more than 1600, or from 1600 to 3000.

The PIB may be conventional PIB or highly reactive and/or high vinylidene PIB. In one embodiment the PIB used is conventional PIB, in another embodiment the PIB used is highly reactive PIB, and in still another embodiment the PIB used is a mixture of conventional and highly reactive PIB.

The amine which reacts with the succinic acylating agent may be a polyamine. The polyamine may be aliphatic, cycloaliphatic, heterocyclic or aromatic. Examples of the polyamines include alkylene polyamines, hydroxy containing polyamines, aromatic polyamines, and heterocyclic polyamines. Such alkylenepolyamines include ethylenepolyamines, butylenepolyamines, propylenepolyamines, pentylenepolyamines, etc. The higher homologs and related heterocyclic amines such as piperazines and N-aminoalkyl-substituted piperazines are also included. Specific examples of such polyamines are ethyllenediamine, diethylenetriamine (DETA), triethylenetetramine (TETA), tris-(2-aminoethyl) amine, propylenediamine, trimethylenediamine, tripropylenetetramine, tetraethylenepentamine (TEPA), hexaethylene-heptamine, pentaethylenehexamine, and mixtures thereof.

Suitable polyamines also include ethylenepolyamines, as described under the heading Ethylene Amines in Kirk Othmer's "Encyclopedia of Chemical Technology", 2d Edition, Vol. 7, pages 22-37, Interscience Publishers, New York (1965). These materials are a complex mixture of polyalkylenepolyamines including cyclic condensation products such as the aforedescribed piperazines.

Other useful types of polyamine mixtures are those resulting from stripping the above-described polyamine mixtures to leave a residue often termed "polyamine bottoms". In general, alkylenepolyamine bottoms can be characterized as having less than two, usually less than 1%, (by weight) material boiling below 200° C. A typical sample of such ethylene polyamine bottoms obtained from the Dow Chemical Company of Freeport, Tex. designated "E-100" has a specific gravity at 15.6° C. of 1.0168, a percent nitrogen by weight of 33.15 and a viscosity at 40° C. of 121 centistokes. Gas chromatography analysis of such a sample contains 0.93% "Light Ends" (most probably DETA), 0.72% TETA, 21.74% TEPA and 76.61% pentaethylenehexamine and higher (by weight). These alkylenepolyamine bottoms include cyclic condensation products such as piperazine and higher analogs of diethylenetriamine, triethylenetetramine and the like. These alkylenepolyamine bottoms can be reacted with the acylating agent alone or can be used with other amines and/or polyamines.

In some embodiments the nitrogen-containing dispersant is derived from the reaction of one or more of the amines described above and a fatty carboxylic acid. Suitable fatty carboxylic acids include both mono and di carboxylic acids with a hydrocarbyl containing from 6, 10 or 12 to 100, 60, 30, or 24 carbon atoms. The hydrocarbyl group may be linear or branched, and in some embodiments contains a single methyl branch at the end of the hydrocarbyl chain. Specific examples of suitable acids include dodecanoic acid, tetradecanoic acid, palmitic acid, stearic acid (including isostearic acid), icosanoic acid, and the like. In some embodiments smaller acids may be used in combination with the acid described above, such as adipic acid, succinic acid, octanedioic acid, and the like. In some embodiments these nitrogen-containing dispersant are prepared from isostearic acid and an alkylene polyamine such as DETA, TETA and/or TEPA.

The nitrogen-containing dispersants may also be borated. Typically, the borated dispersant contains from 0.1% to 5%, or from 0.5% to 4%, or from 0.7% to 3% by weight boron. In one embodiment, the borated dispersant is a borated acylated amine, such as a borated succinimide dispersant. Borated dispersants are described in U.S. Pat. Nos. 3,000,916; 3,087,936; 3,254,025; 3,282,955; 3,313,727; 3,491,025; 3,533,945; 3,666,662 and 4,925,983. Borated dispersant are prepared by reaction of one or more dispersants with one or more boron compounds. Any of the dispersants described herein may be borated, either during the reaction of the hydrocarbyl substituted acylating agent and the amine or after.

In one embodiment, the boron compound is an alkali or mixed alkali metal and alkaline earth metal borate. These metal borates are generally hydrated particulate metal borates which are known in the art. Alkali metal borates include mixed alkali and alkaline metal borates. U.S. Pat. Nos. 3,997,454; 3,819,521; 3,853,772; 3,907,601; 3,997,454; and 4,089,790 disclose suitable alkali and alkali metal and alkaline earth metal borates and their methods of manufacture. In one embodiment the boron compound is boric acid.

The nitrogen-containing dispersants of the present invention may also be post-treated by reaction with any of a variety of agents besides borating agents. Among these are urea, thiourea, dimercaptothiadiazoles, carbon disulfide, aldehydes, ketones, carboxylic acids, hydrocarbon-substituted succinic anhydrides, nitriles, epoxides, and phosphorus compounds. References detailing such treatment are listed in U.S. Pat. No. 4,654,403.

In one embodiment, the nitrogen-containing dispersant of the present invention is borated and may also be derived from PIB having an Mn of less than 1600, or from 850 or 900 to 1500 or 1200.

In one embodiment, the nitrogen-containing dispersant of the present invention is any one or more of the following: a borated succinimide dispersant derived from the reaction of boric acid, a mixture of polyethylene polyamines and/or bottoms, and a polyisobutenyl succinic anhydride derived from conventional PIB; a borated succinimide dispersant derived from the reaction of boric acid, a mixture of polyethylene polyamines and/or bottoms, and a polyisobutenyl succinic anhydride derived from high vinylidene PIB; a borated dispersant derived from the reaction of a polyisobutenyl succinimide dispersant and boric acid where the dispersant is derived from a mixture of polyethylene polyamines and/or bottoms, and a polyisobutenyl succinic anhydride derived from conventional PIB; a non-borated polyisobutenyl succinimide dispersant derived from a polyisobutenyl succinic anhydride derived from high vinylidene PIB and TEPA; a non-borated alkyl imidazoline derived from a polyalkylene amine and a fatty mono-carboxylic acid.

In still other embodiments, the nitrogen containing dispersant used in the stabilizing component of the present invention includes at least one hydrocarbyl group containing from 10, 20 or 40 to 500, 400 or 250 carbon atoms. The dispersant may also have a TBN (as defined below and as measured by ASTM D4739) of at least 9, 10, 15 or 20. In the case where the dispersant is borated, its TBN may be at least 9. In the case where the dispersant is not borated, its TBN may be at least 20. In further embodiments, where the dispersant is borated, it may contain at least 0.1, 0.2, 0.4 percent by weight boron. The borated dispersant may contain from 0.1, 0.2 or 0.4 to 4 or 2 percent by weight boron. In still other embodiments, the dispersant may have an N:CO ratio of greater than 0.7:1. The N:CO ratio of a dispersant is the ratio of the equivalents of amino groups to carboxylic groups within the dispersant molecule. In the case where the dispersant is borated, its N:CO ratio may be at least 0.7:1 or at least 0.75:1. In the case where the dispersant is not borated, the N:CO ratio may have a higher limit, for example the N:CO ratio may be at least 1:1 or 1.3:1, or even at least 1.6:1. The N:CO ratio of the dispersants is generally not higher than 4:1, 3:1 or 2:1. Any one of the features describe above may be used in combination with the others.

The Overbased Detergent.

As noted above, the stabilizing component may also include an overbased detergent. Suitable detergents have a metal to substrate ratio of greater than 3:1. Overbased materials, also referred to as overbased or super-based salts, are generally single phase, homogeneous Newtonian systems characterized by an amount of excess metal base that which would be necessary for neutralization according to the stoichiometry of the metal base and the particular acidic organic compound reacted with the metal base. The amount of excess metal is commonly expressed in terms of "substrate to metal ratio" which is the ratio of the total equivalents of the metal to the equivalents of the substrate. A more detailed description of the term metal ratio is provided in "Chemistry and Technology of Lubricants", Second Edition, Edited by R. M. Mortier and S. T. Orszulik, pages 85 and 86, 1997.

The basicity of overbased materials is generally expressed in terms of a total base number (TBN). A TBN is the amount of acid (perchloric or hydrochloric) needed to neutralize all of the overbased material's basicity. The amount of acid is expressed as potassium hydroxide (mg KOH per gram of sample). TBN is determined by titration of overbased material with 0.1 Normal hydrochloric acid solution using bromophenol blue as an indicator. The equivalents of an overbased material are determined by the following equation: equivalent weight=(56,100/TBN). The overbased materials of the present invention generally have a total base number of at least 100 or 200 or 250 or 255 and generally less than 450 or no more than 400.

Overbased detergents may be prepared by reacting an acidic material (typically an inorganic acid or lower carboxylic acid, for example carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter. Useful acidic organic compounds include carboxylic acids, sulfonic acids, phosphorus-containing acids, phenols (including alkylated phenols) or mixtures of two or more thereof. In some embodiments the acidic organic compounds are sulfonic acids or phenols. Throughout this specification, any reference to acids, such as carboxylic or sulfonic acids, is intended to include the acid-producing derivatives thereof such as anhydrides, lower alkyl esters, acyl halides, lactones and mixtures thereof, unless otherwise specifically stated.

Suitable overbased detergents include overbased calcium sulfonates, which are derived from sulfonic acids. Suitable acids include sulfonic and thiosulfonic acids, and salts thereof, and also include mono or polynuclear aromatic or cycloaliphatic compounds. The oil-soluble sulfonates can be represented for the most part by one of the following formulae: $R_2$-T-$(SO_3^-)_a$ and $R_3$—$(SO_3^-)_b$, wherein T is a cyclic nucleus such as benzene, toluene, naphthalene, anthracene, diphenyl oxide, diphenyl sulfide, petroleum naphthenes, or combinations thereof; $R_2$ is an aliphatic group such as alkyl, alkenyl, alkoxy, alkoxyalkyl, or combinations thereof; $(R_2)$+T contains a total of at least 15 carbon atoms; and $R_3$ is an aliphatic hydrocarbyl group containing at least 15 carbon atoms. $R_3$ may be an alkyl, alkenyl, alkoxyalkyl, or carboalkoxyalkyl group. In one embodiment, the sulfonic acids have a substituent ($R_2$ or $R_3$) derived from one of the above-described polyalkenes, and in some embodiments may be derived from PIB, as described above.

The production of sulfonates from detergent manufactured by-products by reaction with, e.g., $SO_3$, is well known to those skilled in the art. See, for example, the article "Sulfonates" in Kirk-Othmer "Encyclopedia of Chemical Technology", Second Edition, Vol. 19, pp. 291 et seq. published by John Wiley & Sons, N.Y. (1969).

The metal compounds useful in making the basic metal salts are generally any Group 1 or Group 2 metal compounds. In some embodiments the metal used is sodium or potassium, or even sodium. In other embodiments the metals of the metal base include the Group 2a alkaline earth metals such as magnesium, calcium, and barium, as well as the Group 2b metals such as zinc or cadmium. In some embodiments the Group 2 metals are magnesium, calcium, barium, or zinc, and in some embodiments magnesium or calcium, or even calcium. The metal compounds may be delivered as metal salts. The anionic portion of the salt can be hydroxide, oxide, carbonate, borate, and/or nitrate.

An acidic material may be used to accomplish the formation of the overbased detergent. The acidic material may be a liquid such as formic acid, acetic acid, nitric acid, and/or sulfuric acid. Acetic acid is particularly useful. Inorganic acidic materials may also be used such as HCl, $SO_2$, $CO_2$, and $H_2S$. In some embodiments the material used is $CO_2$, often used in combination with acetic acid. An acidic gas may be employed to accomplish the formation of the overbased detergent, such as carbon dioxide or sulfur dioxide.

A promoter is a chemical employed to facilitate the incorporation of metal into the basic metal compositions. A particularly comprehensive discussion of suitable promoters is found in U.S. Pat. Nos. 2,777,874, 2,695,910, and 2,616,904. These include the alcoholic and phenolic promoters. The alcoholic promoters include the alkanols of 1 to 12 carbon atoms such as methanol, ethanol, amyl alcohol, octanol, isopropanol, and mixtures of these and the like. Phenolic promoters include a variety of hydroxy-substituted benzenes and naphthalenes. Mixtures of various promoters are sometimes used.

The overbased salt may also be a borated complex. Borated complexes of this type can be prepared by heating the basic metal salt with boric acid at about 50-100° C., the number of equivalents of boric acid being roughly equal to the number of equivalents of metal in the salt. U.S. Pat. No. 3,929,650 discloses such borated complexes and their preparation.

Suitable overbased detergents also include those derived from phenol and alkylated phenols, which may be referred to as phenates, for example calcium phenate sulfides. The phenate may be a sulphur-containing phenate, a methylene-bridged phenate, or mixtures thereof. In one embodiment the phenate is sulphur-containing/coupled phenate. Such materials are described in U.S. Pat. No. 6,551,965 and EP Publications EP 1903093 A, EP 0601721 A, EP 0271262B2 and EP 0273588 B2.

Suitable phenate detergents may be formed by reacting an alkylphenol, an alkaline earth metal base and sulfur, typically carried out in the presence of a promoter solvent to form a sulfurized metal phenate. The alkylphenols useful in the present invention are of the formula $R(C_6H_4)OH$ where R is a straight chain or branched chain alkyl group having from 8 to 40 or from 10 to 30 carbons, and the moiety $(C_6H_4)$ is a benzene ring. Examples of suitable alkyl groups include octyl, decyl, dodecyl, tetradecyl, and hexadecyl groups The alkaline earth metal base can be any of those described above and in some embodiments are calcium and/or magnesium. Examples include calcium oxide, calcium hydroxide, barium oxide, barium hydroxide, magnesium oxide, and the like. Calcium hydroxide, also called hydrated lime, is most commonly used. The promoter solvent, also called a mutual solvent, can be any stable organic liquid which has appreciable solubility for the alkaline earth metal base, the alkylphenol, and the sulfurized metal phenate intermediate. Suitable solvents include glycols and glycol monoethers such as ethylene glycol, 1,4-butane diol, and derivatives of ethylene glycol, such as monomethyl ether, monoethyl ether, etc. In one embodiment the solvent is one or more vicinal glycols and in another embodiment the solvent includes ethylene glycol. The sulfur used in the reaction may be elemental sulfur, in the form of molten sulfur.

In some embodiments the phenate detergent is prepared in the presence of a co-surfactant. Suitable co-surfactants include low base alkylbenzene sulfonates, hydrocarbyl substituted acylating agents such as polyisobutenyl succinic anhydrides (PIBSA), and succinimide dispersants such as polyisobutenyl succinimides. Suitable sulfonates include sulfonic acid salts having a molecular weight preferably of more than 400 obtained by sulfonating alkyl-benzenes derived from olefins or polymers of C2-C4 olefins of chain length C15-C80 and alkaline earth metals such as calcium, barium, magnesium etc. Suitable co-surfactants include and/or may be derived from PIBSA, which may itself be derived from 300 to 5000, or 500 to 3000, or 800 to 1600 number average molecular weight polyisobutylene.

As noted above, these phenate detergents are overbased by reacting them with carbon dioxide gas in the presence of additional alkaline earth meal base, typically in the presence of a promoter solvent. In one embodiment, the phenate sulfide detergents of the composition can be represented by the formula:

(VII)

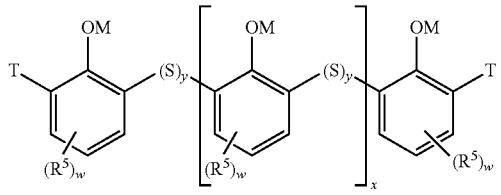

wherein the number of sulphur atoms y can be in the range from 1 to 8, 6 or 4; $R^5$ can be hydrogen or hydrocarbyl groups; T is hydrogen or an $(S)_y$ linkage terminating in hydrogen, an ion or a non-phenolic hydrocarbyl group; w can be an integer from 0 to 4; and M is hydrogen, a valence of a metal ion, an ammonium ion and mixtures thereof.

When M is an equivalent of a metal ion, the metal can be monovalent, divalent, trivalent or mixtures of such metals. When monovalent, the metal M can be an alkali metal, such as lithium, sodium, potassium or combinations thereof. When divalent, the metal M can be an alkaline earth metal, such as magnesium, calcium, barium or mixtures of such metals. When trivalent, the metal M can be aluminum. In one embodiment the metal is an alkaline earth metal and in another embodiment the metal is calcium.

The monomeric units of the above combine in such a way with itself x number of times to form oligomers of hydrocarbyl phenol. Oligomers are described as dimers, trimers, tetramers, pentamers and hexamers when x is equal to 0, 1, 2, 3, and 4. Typically the number of oligomers represented by x can be in the range from 0, 1 to 10, 9, 8, 6, 5 or even 2. Typically an oligomer is present in significant quantities if concentrations are above 0.1, 1 or even 2 percent by weight. Typically an oligomer is present in trace amounts if concentrations are less than 0.1 percent by weight. Generally for at least 50 percent of the molecules, x is 2 or higher. In some embodiments the overall sulfurcontaining phenate detergent contains less than 20 percent by weight dimeric structures.

In the structure above each $R^5$ can be hydrogen or a hydrocarbyl group containing from 4, 6, 8 or 9 to 80, 45, 30 or 20 carbon atoms, or 14 carbon atoms. The number of $R^5$ substituents (w) other than hydrogen on each aromatic ring can be in the range from 0 or 1 to 4, 3 or 2, or be just 1. Where two or more hydrocarbyl groups are present they may be the same or different and the minimum total number of carbon atoms present in the hydrocarbyl substituents on all the rings, to ensure oil solubility, can be 8 or 9. The preferred components include 4-alkylated phenols containing alkyl groups with the number of carbon atoms between 9 and 14, for example 9, 10, 11, 12, 13, 14 and mixtures thereof. The 4-alkylated phenols typically contain sulphur at position 2. The phenate detergent represented by the structure above may also be overbased using an alkaline earth metal base, such as calcium hydroxide.

In some embodiments the phenate detergent used in the present invention is an overbased sulfurized alkaline earth metal hydrocarbyl phenate, which may optionally be modified by the incorporation of at least one carboxylic acid having the formula: R—CH($R^1$)—COOH where R is a $C_{10}$ to $C_{24}$ straight chain alkyl group and $R^1$ is hydrogen, or an anhydride or ester thereof. Such overbased phenates may be prepared by reacting: (i) a non-overbased sulfurized alkaline earth metal hydrocarbyl phenate as described above, (ii) an alkaline earth metal base which may be added as a whole or in increments, (iii) either a polyhydric alcohol having from 2 to 4 carbon atoms, a di- or tri-($C_2$ to $C_4$) glycol, an alkylene glycol alkyl ether or a polyalkylene glycol alkyl ether, (iv) a lubricating oil present as a diluent, (v) carbon dioxide added subsequent to each addition of component (ii), and optionally (vi) at least one carboxylic acid as defined above.

Component (ii) may be any of the earth metal based described above and in some embodiments is calcium hydroxide.

Component (iii) may suitably be either a dihydric alcohol, for example ethylene glycol or propylene glycol, or a trihydric alcohol, for example glycerol. The di- or tri-($C_2$ to $C_4$) glycol may suitably be either diethylene glycol or triethyllene glycol. The alkylene glycol alkyl ether or polyalkylene glycol alkyl ether may suitably be of the formula: $R(OR^1)_xOR^2$ where R is a $C_1$ to $C_6$ alkyl group, $R^1$ is an alkylene group, $R^2$ is hydrogen or $C_1$ to $C_6$ alkyl and x is an integer in the range from 1 to 6. Suitable examples include the monomethyl or dimethyl ethers of ethyleneglycol, diethylene glycol, triethylene glycol or tetraethylene glycol. A particularly suitable solvent is methyl digol. Mixtures of glycols and glycol ethers may also be employed. In some embodiments the glycol or glycol ether is used in combination with an inorganic halide. In one embodiment, component (c) is either ethyllene glycol or methyl digol, the latter in combination with ammonium chloride and acetic acid.

In some embodiments, component (vi), the carboxylic acid used to modify the phenate has an R group that is an unbranched alkyl group, which may contain from 10 to 24 or 18 to 24 carbon atoms. Examples of suitable saturated carboxylic acids include capric acid, lauric acid, myristic acid, palmitic acid, stearic acid, arachidic acid, behenic acid and lignoceric acid. Mixtures of acids may also be employed. Instead of, or in addition to, the carboxylic acid, there may be used the acid anhydride or the ester derivatives of the acid, preferably the acid anhydride. In one embodiment the acid used is stearic acid.

In some embodiments, sulphur additional to that already present by way of component (i), may be added to the reaction mixture. The reaction described above may be carried out in the presence of a catalyst. Suitable catalysts include hydrogen chloride, calcium chloride, ammonium chloride, aluminum chloride and zinc chloride.

In one embodiment, the overbased detergent of the present invention is any one or more of the following: a calcium sulfonate overbased detergent derived from a sulfonic acid, which itself may be derived from conventional PIB; an overbased detergent derived from an alkylated phenol, which itself may be derived from conventional PIB. In some embodiments the detergents have a TBN of at least 200 or at least 255. In other embodiments the calcium sulfonates of the present invention have a TBN of at least 250 or 300. In such embodiments the TBN of the overbased detergent is less than 500, 450 or even no more than 400.

In some embodiments the overbased detergents used in the stabilizing component of the present invention may include one or more of the overbased sulfonates described above having a TBN of at least 200 or 300. The detergents may also include any of the overbased phenate detergents described above having a TBN of at least 30, 50, 120, or at least 200 or 250.

In some embodiments the stabilizing component of the present invention includes a compound that may be represented by the formula:

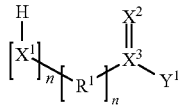

wherein:

$X^1$ is an oxygen atom, a sulfur atom, or $>NR^2$; $X^2$ is an oxygen atom or a sulfur atom; $X^3$ is a carbon atom, S═O, or $P(OR^2)$; $Y^1$ is $—R^2$, $—OR^2$, $—O^{-}{}^{+}NHR^1(R^2)_2$, $—S^{-+}NHR^1(R^2)_2$, $R^1$ is a hydrocarbylene group; $R^2$ is a hydrocarbyl group or —H; and each n is independently 0 or 1.

In some embodiments one or more of the stabilizing components described above are used in combination with one another. In one embodiment, the stabilizer may include: (i) a borated succinimide dispersant derived from the reaction of boric acid, a mixture of polyethylene polyamines and/or bottoms, and a polyisobutenyl succinic anhydride derived from conventional PIB; (ii) a borated succinimide dispersant derived from the reaction of boric acid, a mixture of polyethylene polyamines and/or bottoms, and a polyisobutenyl succinic anhydride derived from high vinylidene PIB; (iii) a borated dispersant derived from the reaction of a polyisobutenyl succinimide dispersant and boric acid where the dispersant is derived from a mixture of polyethylene polyamines and/or bottoms, and a polyisobutenyl succinic anhydride derived from conventional PIB; (iv) a non-borated polyisobutenyl succinimide dispersant derived from a polyisobutenyl succinic anhydride derived from high vinylidene PIB and TEPA; (v) a calcium sulfonate overbased detergent derived from a sulfonic acid, which itself may be derived from conventional PIB; (vi) an overbased detergent derived from an alkylated phenol, which itself may be derived from conventional PIB; (vii) an amine salt of a mixture of phosphoric acids and esters; (viii) an amine salt of a mixture of dithiophosphoric acids and esters; or mixtures thereof. While the friction modifier comprises any of the friction modifiers described above. In some embodiments the friction modifier component includes oleyl tartrimide, stearyl tartrimide, 2-ethylhexyl tartrimide, or combinations thereof; and may also include any of the other friction modifiers described above, particularly the additional friction modifiers that do not have compatibility and/or solubility issues in the medium and/or functional fluid compositions described herein.

INDUSTRIAL APPLICATION

The present invention includes a process of preparing a composition that includes combining: (a) a medium comprising a solvent, a functional fluid, or combinations thereof; (b) a friction modifier component that is not fully soluble in the medium; and (c) a stabilizing component that is soluble in (a) and that interacts with (b) such that (b)'s solubility in (a) is improved. The processes of the present invention involve adding components (b) and (c) to component (a) and mixing the components so that particles of components (b) and (c) have an average diameter of less than 10 microns. The processes of the present invention results in a mixture that is clear and/or stable in that the friction modifier does not drop out of solution, does not make the mixture appear cloudy or hazy, stays suspended, dispersed and/or dissolved in the mixture, or combinations thereof, or that at least shows improvement in one or more of these areas when compared to an identical composition that does not contain the stabilizing component.

While not wishing to be bound by theory, it is believed that in at least some embodiments the compositions of the present invention improve the stability and/or compatibility of the friction modifier component in the overall composition due to the friction modifier component being solubilized in a complex with the solubilizer.

In some embodiments the processes of the present invention result in a mixture with an improved clarity, as defined by a lower JTU and/or NTU value, compared to the same composition that does not contain the stabilizing component.

In some embodiments the compositions of the present invention and/or the compositions that result from the processes of the present invention include both finished functional fluids and additive concentrates. Finished functional fluids are fluids that are ready for use. Additive concentrates are compositions that may contain all of the additives required for a finished fluid, but in concentrated form. This makes shipment and handling easier. At the appropriate time, the additive concentrate may be blended with a fluid, solvent such as oil, or similar diluent, as well as additional additives, to produce a finished functional fluid that is ready for use.

As noted above, components (b) and (c), or (b) alone, may be present in component (a) in the form of dispersed particles having an average diameter of less than 10 microns. In some embodiments the particles have an average diameter of less than 10, 5 or 3 microns. In other embodiments, the particles have an average diameter of from 0.01, 0.02, 0.03 or 0.09 to 10, 6, 5 or 3 microns. In some embodiments 80% of the particles meet one or more of the size limitations described above. In other embodiments 90%, 95%, 99% or even 100% of the particles meet the size limits. That is, in some embodiments no more than 10% by weight of the particles have a diameter of more than 10, 5, 3, 1 or even 0.5 microns. The means by which the particles are formed is not overly limited, and may include the mixing of components (a), (b) and (c) using conventional equipment and/or techniques.

When referring to finished functional fluids, the compositions involved with the present invention may include: from 1, 3 or 10 to 99, 80 or 70 percent by weight of component (a), the medium; from 0.1, 0.15, 0.2, 0.3, 0.5 or 1.0 to 10, 7.5, 5, 4 or 3 percent by weight of component (b), the friction modifier; and from 0.1, 0.2, 0.3, 0.5 or 2.0 to 20, 10, 8, 5, 4 or 2 percent by weight of component (c), the stabilizing component.

When referring to additive concentrates, the compositions involved with the present invention may include: from 0.1, 1, 3 or 10 to 90, 60, 50, 30, or percent by weight of component (a), the medium; from 0.1, 0.15, 0.5, 1, 5 or 8 to 60, 30, 20 or 10 percent by weight of component (b), the friction modifier; and from 0.1, 0.2, 0.3, 0.5 or 2.0 to 20, 10, 8, 5, 4 or 2 percent by weight of component (c), the stabilizing component. As noted above in some embodiments the medium and the stabilizing component may be the same material, in which case the duel functioning material may be present in any of the ranges provided above for either component (a) or (c).

In some embodiments the compositions of the present invention are formed by mixing components (b) and (c) into component (a) such that component (b) forms small particles within component (a) and component (c) acts to stabilize these particles. In some embodiments component (c) and component (b) form mixed particles in component (a). In some embodiments some or all of the particles formed are within the sizes described above. In other embodiments, some or even all of the particles are larger than those described above.

In some embodiments the components of the present invention are mixed by conventional means. The amount of mixing required varies from composition to composition and is that sufficient to produce the particles of the desired size and/or stability. In some embodiments the mixing may be accomplished by milling the components and in still other embodiments the mixing may be accomplished by milling the components at low temperature.

In one such embodiment, a friction modifier, such as stearyl tartrimide may be mixed into oil in the presence stabilizing component, such as a succinimide dispersant, for example polyisobutylene succinimide. The mixing may be in the form of a milling process using conventional milling equipment and techniques. However, in some embodiments the milling is completed at low temperatures, in some embodiments from at less than 30 degrees C. and in other embodiments from −10, 0 or 5 to 30, 25 or 20 degrees C. The low temperature milling may be achieved by cooled milling equipment, pre-cooled components, adding a chilling agent such as dry ice (solid carbon dioxide) to the components during milling, or a combination thereof. The resulting compositions in some embodiments may be described as stable dispersions and in other embodiments may be described as solubilized solutions, or even combinations thereof, where the main difference between such embodiments may be the size of the particles involved.

In other embodiments the compositions of present invention are not formed by milling or any other high-energy input methods, but rather are formed with simple mixing and very little energy input.

In some embodiments the functional fluid with which the compositions of the invention are used is a fuel. The fuel compositions of the present invention comprise the stabilized compositions described above and a liquid fuel, and is useful in fueling an internal combustion engine or an open flame burner. These compositions may also contain one or more additional additives described herein. In some embodiments, the fuels suitable for use in the present invention include any commercially available fuel, and in some embodiments any commercially available diesel fuel and/or biofuel.

The description that follows of the types of fuels suitable for use in the present invention refer to the fuel that may be present in the additive containing compositions of the present invention as well as the fuel and/or fuel additive concentrate compositions to which the additive containing compositions may be added.

Fuels suitable for use in the present invention are not overly limited. Generally, suitable fuels are normally liquid at ambient conditions e.g., room temperature (20 to 30° C.) or are normally liquid at operating conditions. The fuel can be a hydrocarbon fuel, non-hydrocarbon fuel, or mixture thereof.

The hydrocarbon fuel can be a petroleum distillate, including a gasoline as defined by ASTM specification D4814, or a diesel fuel, as defined by ASTM specification D975. In one embodiment the liquid fuel is a gasoline, and in another embodiment the liquid fuel is a non-leaded gasoline. In another embodiment the liquid fuel is a diesel fuel. The hydrocarbon fuel can be a hydrocarbon prepared by a gas to liquid process to include for example hydrocarbons prepared by a process such as the Fischer-Tropsch process. In some embodiments, the fuel used in the present invention is a diesel fuel, a biodiesel fuel, or combinations thereof.

Suitable fuels also include heavier fuel oils, such as number 5 and number 6 fuel oils, which are also referred to as residual fuel oils, heavy fuel oils, and/or furnace fuel oils. Such fuels may be used alone or mixed with other, typically lighter, fuels to form mixtures with lower viscosities. Bunker fuels are also included, which are generally used in marine engines. These types of fuels have high viscosities and may be solids at ambient conditions, but are liquid when heated and supplied to the engine or burner it is fueling.

The non-hydrocarbon fuel can be an oxygen containing composition, often referred to as an oxygenate, which includes alcohols, ethers, ketones, esters of a carboxylic acids, nitroalkanes, or mixtures thereof. Non-hydrocarbon fuels can include methanol, ethanol, methyl t-butyl ether, methyl ethyl ketone, transesterified oils and/or fats from plants and animals such as rapeseed methyl ester and soybean methyl ester, and nitromethane.

Mixtures of hydrocarbon and non-hydrocarbon fuels can include, for example, gasoline and methanol and/or ethanol, diesel fuel and ethanol, and diesel fuel and a transesterified plant oil such as rapeseed methyl ester and other bio-derived fuels. In one embodiment the liquid fuel is an emulsion of water in a hydrocarbon fuel, a non-hydrocarbon fuel, or a mixture thereof.

In several embodiments of this invention the liquid fuel can have a sulphur content on a weight basis that is 50,000 ppm or less, 5000 ppm or less, 1000 ppm or less, 350 ppm or less, 100 ppm or less, 50 ppm or less, or 15 ppm or less.

The liquid fuel of the invention is present in a fuel composition in a major amount that is generally greater than 95% by weight, and in other embodiments is present at greater than 97% by weight, greater than 99.5% by weight, greater than 99.9% by weight, or greater than 99.99% by weight.

The compositions described above may also include one or more additional additives. Such additives include oxidation inhibitors and antioxidants, friction modifiers antiwear agents, corrosion inhibitors, or viscosity modifiers, as well as dispersant and detergents different from those described above. These additional additives may be present in the medium, particularly when the medium includes a functional fluid. When present, these additional additives may represent from 0, 0.1, 0.5 or 1 to 2, 5, 10 or 15 percent of the overall composition, when considering a finished fluid, and from 0, 0.5, 1 or 2 to 4, 10, or 40 percent of the overall composition, when considering an additive concentrate.

As allowed for by the ranges above, in one embodiment, the additive concentrate may comprise the additives of the present invention and be substantially free of any additional solvent. In these embodiments the additive concentrate containing the additives of the present invention is neat, in that it does not contain any additional solvent added to improve the material handling characteristics of the concentrate, such as its viscosity.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring); substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy); hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic or anionic sites of other molecules. In addition the acylating agents and/or substituted hydrocarbon additives of the present invention may form salts or other complexes and/or derivatives, when interacting with other components of the compositions in which they are used. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

Unless otherwise indicates all percent values and ppm values herein are weight percent values and/or calculated on a weight basis.

EXAMPLES

The invention will be further illustrated by the following examples, which sets forth particularly advantageous embodiments. While the examples are provided to illustrate the present invention, they are not intended to limit it.

Example Set 1

A set of samples is prepared by adding a friction modifier known to have compatibility issues to a fully formulated 10W-30 passenger car motor oil. The friction modifier used in these samples is a hydroxy-carboxylic acid derived additive formed by the condensation reaction of tartaric acid and a fatty amine and was added to an overall content of 2 weight percent (on an actives basis). Also to each sample, 5 weight percent of a candidate stabilizing component is added. The mixture is heated up to 100 degrees Celsius and stirred until clear. Each sample was then cooled and stored at room temperature. Each sample was then checked at 1 hour, 1 day, 3 days and 1 week after the being placed in storage to check for cloudiness, haziness and even for drop out of the friction modifier. The stabilizing components used in these samples include: oleylamine (Example 1-1); isotridecyl isatoic ester (Example 1-2); an amino phenol with a 500 Mn polyisobutenyl substituent group (Example 1-3); esterified isoxazoline (Example 1-4); a non-borated alkyl imidazoline derived from a polyalkylene amine and a fatty mono-carboxylic acid (Example 1-5); an alkaryl amine derived from diphenylamine (Example 1-6); a non-borated 2000 Mn polyisobutyleve succinimide dispersant with a N:CO ratio of <1:1 (Example 1-7); a non-borated 1000 Mn polyisobutylene succinimide dispersant with a N:CO ratio of >1.6:1 (Example 1-8); a non-borated 500 Mn polyisobutylene succinimide dispersant with a N:CO ratio of >1.6:1 (Example 1-9); a non-borated 2000 Mn polyisobutylene succinimide dispersant with a N:CO ratio of <1.6:1 (Example 1-10); a non-borated 2000 Mn polyisobutylene succinimide dispersant with a N:CO ratio of <1.6:1 derived from a different amine than Example 1-10 (Example 1-11); a non-borated 2000 Mn polyisobutylene succinimide dispersant with a N:CO ratio of <1.1:1 (Example 1-12); a non-borated 2000 Mn polyisobutylene succinimide dispersant with a N:CO ratio of <1.1:1 derived from a different amine than Example 1-12 (Example 1-13); a non-borated 2000 Mn polyisobutylene succinimide dispersant with a N:CO ratio of <0.8:1 (Example 1-14); a 300 TBN calcium sulfonate overbased detergent (Example 1-15); a 400 TBN calcium sulfonate overbased detergent (Example 1-16); a 255 TBN calcium phenate sulfide overbased detergent (Example 1-17); a >10 TBN salixarene detergent (Example 1-18).

The results from Example Set 1 are provided in the table below:

TABLE 1

Results from Example Set 1.

| Example | At T = 0 | At 1 hr | At 4 hr | At 3 days | At 1 week |
|---|---|---|---|---|---|
| 1-1 | CLEAR | CLOUDY | CLOUDY | CLOUDY | CLOUDY |
| 1-2 | CLEAR | CLOUDY | CLOUDY | CLOUDY | CLOUDY |
| 1-3 | CLEAR | CLEAR | CLEAR | CLEAR | SEDIMENT |
| 1-4 | CLEAR | CLEAR | CLOUDY | CLOUDY | CLOUDY |
| 1-5 | CLEAR | CLEAR | CLEAR | CLEAR | CLEAR |
| 1-6 | CLEAR | CLOUDY | CLOUDY | CLOUDY | CLOUDY |
| 1-7 | CLEAR | CLEAR | CLOUDY | CLOUDY | CLOUDY |
| 1-8 | CLEAR | CLEAR | CLEAR | CLEAR | CLEAR |
| 1-9 | CLEAR | CLEAR | CLOUDY | CLOUDY | CLOUDY |
| 1-10 | CLEAR | CLEAR | CLEAR | CLOUDY | CLOUDY |
| 1-11 | CLEAR | CLOUDY | CLOUDY | CLOUDY | CLOUDY |
| 1-12 | CLEAR | CLEAR | CLOUDY | CLOUDY | CLOUDY |
| 1-13 | CLEAR | CLEAR | CLOUDY | CLOUDY | CLOUDY |
| 1-14 | CLEAR | CLEAR | CLOUDY | CLOUDY | CLOUDY |
| 1-15 | CLEAR | CLEAR | CLEAR | CLEAR | CLEAR |
| 1-16 | CLEAR | CLEAR | CLOUDY | CLOUDY | CLOUDY |
| 1-17 | CLEAR | CLEAR | CLEAR | CLOUDY | CLOUDY |
| 1-18 | CLEAR | CLOUDY | CLOUDY | CLOUDY | CLOUDY |

The results of Example Set 1 show that some materials effectively stabilize 2 weight percent of the hydroxy-carboxylic acid derived friction modifier used, while others do not. This study was used to prepare a second sample set, which is described below, designed to further study the important parameters at play and confirm the results.

A set of Examples is prepared as outlined above, except that Example Set 2 uses a different set of stabilizing components, treats the samples at 1.6 weight percent (actives basis) of the same friction modifier, and evaluates the samples for clarity at 1 hour, 4 hours, 1 day, 4 days and 7 days.

The stabilizing components used in these samples include: a non-borated 1000 Mn polyisobutylene succinimide dispersant with a N:CO ratio of >1.6:1 (Example 2-1); a non-borated 1000 Mn polyisobutylene succinimide dispersant with a N:CO ratio of >1.6:1 (Example 2-2); an amino phenol with a 1000 Mn polyisobutenyl substituent group (Example 2-3); a 110 TBN hydroxyyalkylamine substituted phenol (Example 2-4); a 1000 Mn polyisobutylene succinic anhydride (Example 2-5); the stabilizer of Example 1-5 as described above (Example 2-6); the stabilizer of Example 1-10 as described above (Example 2-7); the stabilizer of Example 1-14 as described above (Example 2-8); the stabilizer of Example 1-13 as described above (Example 2-9); the stabilizer of Example 1-11 as described above (Example 2-10); the stabilizer of Example 1-7 as described above (Example 2-11); the stabilizer of Example 1-16 as described above (Example 2-12); the stabilizer of Example 1-15 as described above (Example 2-13); a 85 TBN calcium sulfonate overbased detergent (Example 2-14); a 10 TBN calcium sulfonate detergent (Example 2-15).

The results from Example Set 2 are provided in the table below:

TABLE 2

Results from Example Set 2.

| Example | At T = 0 | At 1 hr | At 4 hr | At 4 hr | At 4 days | At 1 week |
|---|---|---|---|---|---|---|
| 2-1 | CLEAR | CLEAR | CLEAR | CLEAR | CLEAR | CLEAR |
| 2-2 | CLEAR | CLEAR | CLEAR | CLEAR | CLEAR | CLEAR |
| 2-3 | CLEAR | CLEAR | CLOUDY | CLOUDY | CLOUDY | CLOUDY |
| 2-4 | CLEAR | CLEAR | CLEAR | CLEAR | CLOUDY | CLOUDY |
| 2-5 | CLEAR | CLEAR | CLEAR | CLOUDY | CLOUDY | CLOUDY |
| 2-6 | CLEAR | CLEAR | CLEAR | CLEAR | CLEAR | CLEAR |
| 2-7 | CLEAR | CLEAR | CLOUDY | CLOUDY | CLOUDY | CLOUDY |
| 2-8 | CLEAR | CLOUDY | CLOUDY | CLOUDY | CLOUDY | CLOUDY |
| 2-9 | CLEAR | CLEAR | CLOUDY | CLOUDY | CLOUDY | CLOUDY |
| 2-10 | CLEAR | CLEAR | CLOUDY | CLOUDY | CLOUDY | CLOUDY |
| 2-11 | CLEAR | CLOUDY | CLOUDY | CLOUDY | CLOUDY | CLOUDY |
| 2-12 | CLEAR | CLEAR | CLEAR | CLEAR | CLEAR | CLEAR |
| 2-13 | CLEAR | CLEAR | CLEAR | CLEAR | CLEAR | CLEAR |
| 2-14 | CLEAR | CLEAR | CLOUDY | CLOUDY | CLOUDY | CLOUDY |
| 2-15 | CLEAR | CLEAR | CLOUDY | CLOUDY | CLOUDY | CLOUDY |

The results of Example Set 2 show that the stabilizing components of the present invention effectively stabilize 2 weight percent of the hydroxycarboxylic acid derived friction modifier used, while others materials do not.

Example Set 3

A third set of samples is prepared by mixing various levels of a stabilizing component and a friction modifier component into a lubricating composition. The mixtures are prepared by adding a set amount of friction modifier component to a lubricating composition and then adding incremental amounts of a specific stabilizing component to each sample to see how much stabilizer is needed in order for the lubricating composition to stabilize. That is, to show no haziness and/or cloudiness from the friction modifier component after storage at room temperature for up to a week, or at least some improvement in stability. The samples are each prepared and evaluated according to the procedures discussed above. The amount of stabilizing component required to stabilize the set amount of friction modifier component in the lubricating composition is recorded and the steps are repeated at another concentration level for the friction modifier component.

The lubricating composition used in this sample set is a fully formulated 0W20 GF-5 engine oil composition. The composition is clear when 0 wt % of the friction modifier component is present. The friction modifier component used in these samples is a hydroxy-carboxylic acid derived additive formed by the condensation reaction of tartaric acid and a fatty amine. The stabilizing components used in these samples include: a borated succinimide dispersant derived from the reaction of boric acid, a mixture of polyethylene polyamines and/or bottoms, and a polyisobutenyl succinic anhydride derived from conventional PIB (Example 3-1); a borated succinimide dispersant derived from the reaction of boric acid, a mixture of polyethylene polyamines and/or bottoms, and a polyisobutenyl succinic anhydride derived from high vinylidene PIB (Example 3-2); a borated dispersant derived from the reaction of a polyisobutenyl succinimide dispersant and boric acid where the dispersant is derived from a mixture of polyethylene polyamines and/or bottoms, and a polyisobutenyl succinic anhydride derived from conventional PIB (Example 3-3); a non-borated polyisobutenyl succinimide dispersant derived from a polyisobutenyl succinic anhydride derived from high vinylidene PIB and a polyamine (Example 3-4); a calcium sulfonate overbased detergent derived from a sulfonic acid, itself derived from conventional PIB (Example 3-5); an amine salt of a mixture of phosphoric and/or dithiophosphoric acids and esters (Example 3-6); a mixture of phosphoric and/or dithiophosphoric acids and esters (Example 3-7).

The table below summarizes the results of the example set.

TABLE 3

Results from Example Set 3.

| Example (Stabilizer Used) | Wt % Friction Modifier Present | Min wt % Required for Clarity |
|---|---|---|
| Ex 3-1 | 1.0 wt % | 1.0 wt % |
| | 2.0 wt % | 3.0 wt % |
| Ex 3-2 | 0.7 wt % | 0.5 wt % |
| | 2.0 wt % | 5.0 wt % |
| Ex 3-3 | 1.0 wt % | 3.0 wt % |
| | 2.0 wt % | 8.0 wt % |
| Ex 3-4 | 0.8 wt % | 0.5 wt % |
| | 1.2 wt % | 3.5 wt % |
| | 2.0 wt % | 5.0 wt % |
| Ex 3-5 | 0.3 wt % | 0.5 wt % |
| | 0.5 wt % | 1.8 wt % |
| | 0.6 wt % | 1.8 wt % |
| | 1.0 wt % | 7.9 wt % |
| | 2.0 wt % | 10.9 wt % |
| Ex 3-6 | 0.5 wt % | 1.0 wt % |
| | 1.0 wt % | 3.0 wt % |
| Ex 3-7 | 1.2 wt % | 4.0 wt % |

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about."

Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration. As used herein the term polyisobutenyl means a polymeric alkenyl group derived from polyisobutylene, which may be a saturated or unsaturated group.

We claim:

1. A composition comprising:

(a) a medium comprising a solvent, a functional fluid, an additive concentrate, or combinations thereof; and (b) a friction modifier component comprising a condensation product of a tartaric acid and a linear fatty amine of 10 to 24 carbon atoms wherein said condensation product is not fully soluble in the medium; and (c) a stabilizing component comprising a phosphorus containing additive that is soluble in (a) and that interacts with (b) such that the solubility of (b) in (a) is improved, wherein said stabilizing component is present at about 2% to about 8% by weight of said composition;

wherein component (b) is present in component (a) in the form of dispersed particles wherein no more than 10 percent by weight of the particles have a diameter of more than 0.5 microns wherein component (b) is present in the overall composition at a level of more than 1.0 percent by weight; and wherein the phosphorus containing additive of component (c) comprises an amine salted version of a compound represent by the following formula:

$$(X^1{=})_aP(X^2{}_b{-}R)_3$$

wherein:

each $X^1$ is independently O or S, a is 0 or 1, each $X^2$ is independently O or S, b is 0 or 1, and R is H or a hydrocarbyl group.

2. The composition of claim 1 wherein the turbidity of the overall composition is improved, as defined by a lower JTU and/or NTU value compared to the same composition that does not contain (c), the stabilizing component.

3. The composition of claim 1 wherein the friction modifier further includes oleyl tartrimide, stearyl tartrimide, or combinations thereof.

4. A process of preparing a clear and stable composition comprising:

(a) a medium comprising a solvent, a functional fluid, an additive concentrate, or combinations thereof; and (b) a friction modifier component comprising a condensation product of a tartaric acid and a linear fatty amine of 10 to 24 carbon atoms wherein said condensation product is not fully soluble in the medium; and (c) a stabilizing component comprising a phosphorus containing additive that is soluble in (a) and that interacts with (b) such that (b)'s solubility in (a) is improved, wherein said stabilizing component is present at about 2% to about 8% by weight of said composition;

said method comprising the steps of:

I. adding components (b) and (c) to component (a) wherein component (b) is present in the overall composition at a level of more than 1.0 percent by weight;

II. mixing the components so that particles of component (b) are present in component (a) in the form of dispersed particles wherein no more than 10 percent by weight of the particles have a diameter of more than 0.5 microns;

wherein the phosphorus containing additive of component (c) comprises an amine salted version of a compound represent by the following formula:

$$(X^1{=})_aP(X^2{}_b{-}R)_3$$

wherein:

each $X^1$ is independently O or S, a is 0 or 1, each $X^2$ is independently O or S, b is 0 or 1, and R is H or a hydrocarbyl group.

5. The process of claim 4 wherein the clarity of the resulting mixture is improved, as defined by a lower JTU and/or NTU value compared to the same composition that does not contain (c), the stabilizing component.

6. The process of claim 4, wherein the friction modifier includes oleyl tartrimide, stearyl tartrimide, or combinations thereof.

7. The composition of claim 1, wherein the linear fatty amine has 12 to 24 carbon atoms.

8. The composition of claim 1, wherein the linear fatty amine has 12 to 18 carbon atoms.

9. The process of claim 4, wherein the linear fatty amine has 12 to 24 carbon atoms.

10. The process of claim 4, wherein the linear fatty amine has 12 to 18 carbon atoms.

* * * * *